US010610449B1

(12) United States Patent
Reaux

(10) Patent No.: US 10,610,449 B1
(45) Date of Patent: Apr. 7, 2020

(54) FLEXIBLE CONTAINERS FOR DISPENSING PRODUCTS SUCH AS MEDICINES WITH SLIDER THEREON

(71) Applicant: Brian K Reaux, Red Oak, TX (US)

(72) Inventor: Brian K Reaux, Red Oak, TX (US)

(73) Assignee: Brian K. Reaux, Red Oak, TX (US)

( * ) Notice: Subject to any disclaimer, the term of this patent is extended or adjusted under 35 U.S.C. 154(b) by 0 days.

(21) Appl. No.: 16/127,316

(22) Filed: Sep. 11, 2018

Related U.S. Application Data

(60) Provisional application No. 62/606,222, filed on Sep. 14, 2017, provisional application No. 62/606,422, filed on Sep. 22, 2017, provisional application No. 62/708,011, filed on Nov. 28, 2017, provisional application No. 62/708,592, filed on Dec. 14, 2017, provisional application No. 62/708,914, filed on Dec. 28, 2017, provisional application No. 62/709,246, filed on Jan. 10, 2018.

(51) Int. Cl.

| | |
|---|---|
| ***A61J 1/03*** | (2006.01) |
| ***B65B 9/04*** | (2006.01) |
| ***B65D 75/36*** | (2006.01) |
| ***B65D 17/28*** | (2006.01) |
| *B65B 5/06* | (2006.01) |

(52) U.S. Cl.
CPC ..... *A61J 1/03* (2013.01); *B65B 9/045* (2013.01); *B65D 17/401* (2018.01); *B65D 75/367* (2013.01); *A61J 2205/30* (2013.01); *B65B 5/06* (2013.01)

(58) Field of Classification Search
CPC ..... A61J 1/03; A61J 2205/30; B65D 17/401; B65D 75/367; B65B 9/045; B65B 5/06
USPC ..... 383/37
See application file for complete search history.

(56) References Cited

U.S. PATENT DOCUMENTS

| | | | | |
|---|---|---|---|---|
| 3,263,904 | A * | 8/1966 | Warp | B65D 29/00 383/106 |
| 4,654,878 | A * | 3/1987 | Lems | B65B 43/123 383/35 |
| 5,788,974 | A * | 8/1998 | D'Amico | A61K 45/06 206/438 |
| 5,908,113 | A * | 6/1999 | Takemasa | B65D 33/002 206/530 |
| 7,828,148 | B2 * | 11/2010 | Gibson | A61J 7/0084 206/528 |
| D780,596 | S | 3/2017 | Sam | |
| 2005/0281490 | A1 * | 12/2005 | Schneider | B65B 9/04 383/61.2 |

(Continued)

*Primary Examiner* — Peter N Helvey
(74) *Attorney, Agent, or Firm* — Stan Collier, Esq.

(57) ABSTRACT

The present invention is a plurality of flexibly connected pouches forming a container having a sliding track along the top edge. The pouches can hold pills, an amount of cannabis, gels, etc., that are sealed in the pouches. The track has two sections that removably attach to each other when pushed together. The track may have a notch located above a tear joint between each pouch. A unique slider has a plow that separates the two sections once the plow is pushed down into the slider. A wedge thereon separates the two sections of the track and thus opens the walls of the pouch. The slider when the plow is not pushed down can be moved along the track as desired. The pouches further can have a tear joint. Further, the pouches may be folded or rolled together and can be placed in a box for sale and storage.

2 Claims, 12 Drawing Sheets

(56) References Cited

U.S. PATENT DOCUMENTS

| | | | | |
|---|---|---|---|---|
| 2006/0168779 | A1* | 8/2006 | Chaturvedi | B65D 33/2591 24/415 |
| 2006/0269171 | A1* | 11/2006 | Turvey | A44B 19/267 383/64 |
| 2007/0071367 | A1* | 3/2007 | Buchman | A44B 19/265 383/64 |
| 2009/0139067 | A1* | 6/2009 | Ackerman | B65D 33/2591 24/400 |
| 2013/0161207 | A1 | 6/2013 | Luciano, Jr. et al. | |
| 2013/0299381 | A9 | 11/2013 | Luciano, Jr. | |
| 2014/0298757 | A1* | 10/2014 | Chapek | B65D 50/00 53/492 |
| 2017/0246082 | A1 | 8/2017 | Pattison et al. | |

* cited by examiner

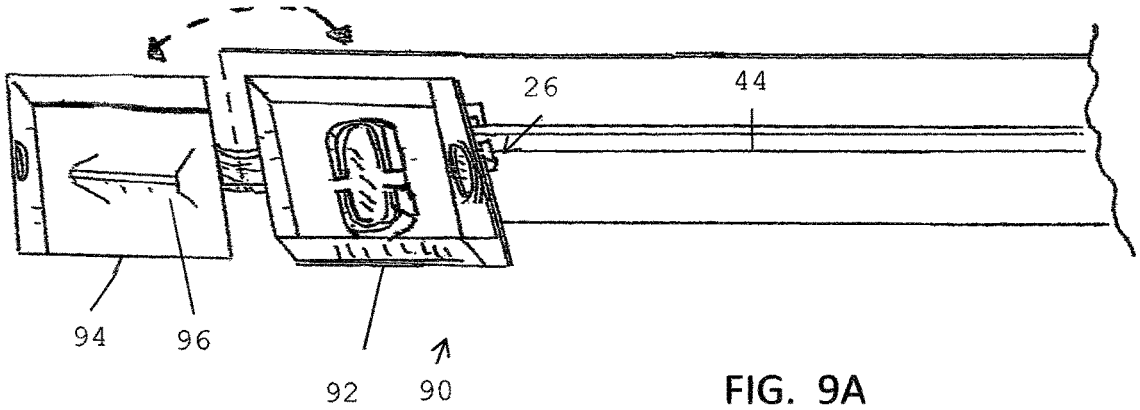
FIG. 9A
FIG. 9B
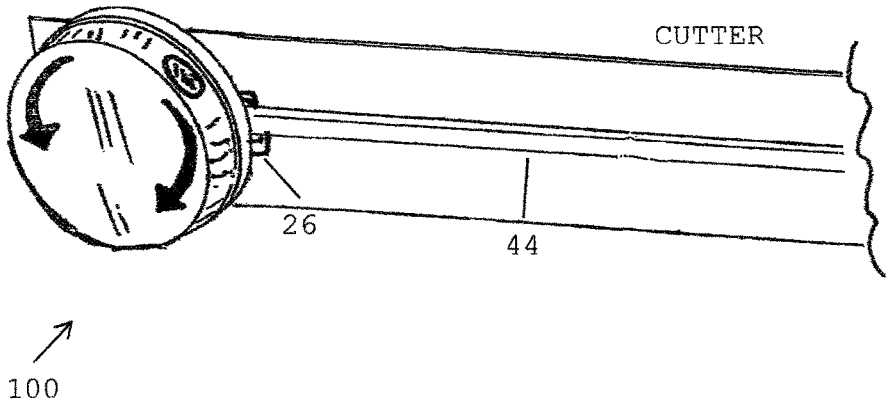
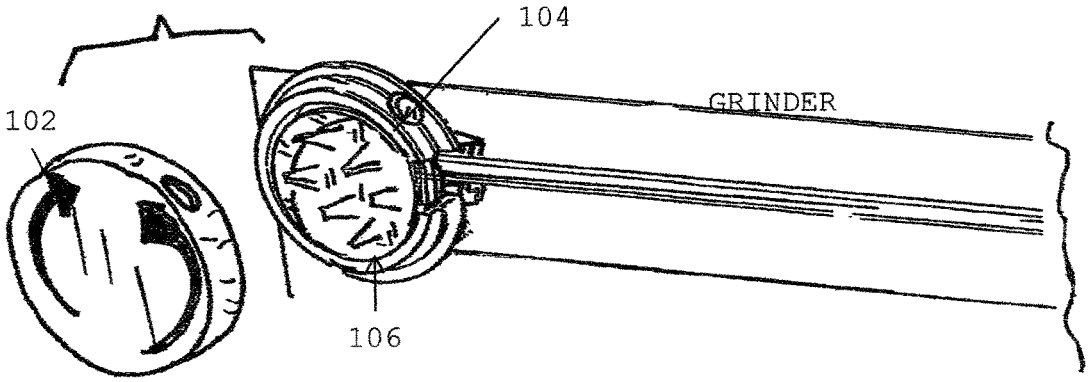
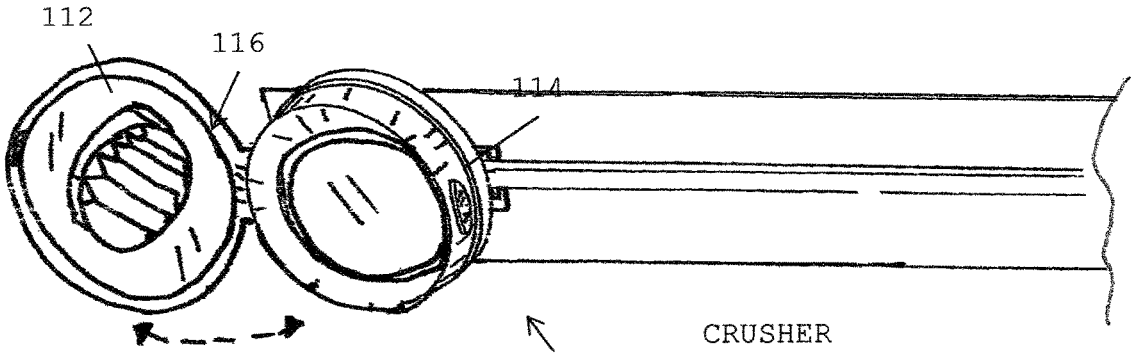
FIG. 9C

FLEXIBLE CONTAINERS FOR DISPENSING PRODUCTS SUCH AS MEDICINES WITH SLIDER THEREON

CROSS REFERENCES TO RELATED APPLICATIONS

This is a regular filing of Ser. No. 62/606,222, filed Sep. 14, 2017, entitled "Ziplock cannabis compartment bag, having sealed walls, and a cutting blade", by Brian K. Reaox (misspelled should be Reaux) and is incorporated herein, also incorporated by reference is Ser. No. 62/606,422, filed Sep. 22, 2017, entitled, "Cannabis container bag with multiple lockable locks, and a child resistant slider and methods", by Brian K. Reaux, and also incorporated by reference, Ser. No. 62/708,011, filed Nov. 28, 2017, entitled, "Child resistance container bag for medical medication having individually compartments", by the same inventor; also incorporated by reference as a provisional Ser. No. 62/708,592, filed Dec. 14, 2017, entitled, "Plurality of medical medication pouches having a child proof slider, and medication cutter crusher, grinder" by Brian K. Reaox (misspelled should be Reaux); also incorporated by reference as a provisional Ser. No. 62/708,914, filed Dec. 28, 2017, entitled, "Child resistant zipper closure for a bag/pouch having a least a pill-tablet cutter, pill or tablet crusher or a cannabis grinder, that is hingedly attached embodiment to the slider body," by Brian K. Reaux; also incorporated by reference as a provisional Ser. No. 62/709,246, filed Jan. 10, 2018, entitled, "Child resistant container for a controlled substance as cannabis or smoking article or the like," by Brian K. Reaux;

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

Field of the Invention

The present invention relates generally to containers for controlling the dispensing of materials, and, more particularly, relates to containers having individual pouches, and, in greater particularity, relates to pouches being connected together for dispensing therefrom.

Description of the Prior Art

Multiple pill containers are used to aid the consumer in dispensing the pills.

One of the conventional containers is shown by US Pat. Pub. 2013/0161207 entitled "Child Resistant Packaging For Multi-Prescription Order," is a cylindrical plastic tube with a twist-off top cap. Another container for such a purpose is shown by US Pat. Pub. 2017/0246082 being a blister package. Each pill is contained in one blister that can be removed before the foil is removed. Another container is shown by US Pat. Pub. 2013/0299381 entitled "Dual Dispensing Tablet Container" is a series of plastic pouches that are connected together. Another related product is shown by an article entitled "Pill Boxes" that can hold strips of pouches. See www.pharmacy automationsupplies.com.

These products and patents are incorporated by reference as prior art.

Accordingly, there is a need for an improved container for dispensing materials safely and in a controlled manner.

SUMMARY OF THE INVENTION

The present invention provides an improved means for dispensing materials safely and in a controlled manner.

The present invention is a plurality of flexibly connected and separable pouches having a track along the top edge with a slider for unlocking. The pouches can hold pills, an amount of cannabis, gels, etc., that are air sealed in the pouches. The track has two sections that removably attach to each other when pushed together. The track has a notch located above a tear joint between each pouch. A unique slider with a plow has a biased plow that separates the two sections once the plow is pushed down into the slider. The slider when the plow is not pushed down can be moved along the track as desired. The pouches further can have a tear joint. Further, the pouches may be folded or rolled together and can be placed in a box for sale and storage. The pouches can be marked with the name of the product as well as usage instructions.

An object of the present invention is to provide an improved container for dispensing products.

It is another object of the present invention to provide an improved container consisting of a plurality of pouches.

It is a further object of the present invention to provide an improved container wherein the pouches may have pills, gels, cannabis or other products.

It is still a further object of the present invention to provide an improved container wherein the pouches are flexably attached together.

It is still another object of the present invention to provide an improved container having a slider traveling upon an track with a plow to open the pouches.

It is still another object of the present invention to provide an improved container further having a pill crusher, pill cutter, or similar features on the slider.

It is still another object of the present invention to provide an improved container wherein each pouch may be separated from a series.

It is still another object of the present invention to provide an improved container wherein each pouch may have thereon instructions as for use.

It is still another object of the present invention to provide an improved container that may be folded and/or rolled up for storage in a box for sales.

These and other objects, features, and advantages of the present invention will become more readily apparent from the attached drawings and the detailed description of the preferred embodiments, which follow.

BRIEF DESCRIPTION OF THE DRAWINGS

FIGS. 9A, 9B, and 9C are perspective views of a pill cutter, FIG. 9A, a pill cutter; FIG. 9B, a pill grinder; FIG. 9C, a pill crusher, all integrated into the slider of FIG. 4 of the present invention;

Like reference numerals refer to like parts throughout the several views of the drawings.

DETAILED DESCRIPTION OF THE PREFERRED EMBODIMENTS

In general, the present invention is a plurality of flexibly connected and separable pouches having a track along the top with a slider for unlocking and locking. The pouches can hold pills, an amount of cannabis, gels, liquids, solids, like ice, etc., that are air sealed in the pouches. The track has two sections that removably attach to each other when pushed together. The track has a notch located above a tear joint between each pouch. The tear joint is located on a vertical sealing area running between the pouches. A unique slider with a plow has a biased plow that separates the two sections once the plow is pushed down into the slider. The slider when the plow is not pushed down can be moved along the track as desired. The pouches further can have a tear joint and are flexible. Further, the pouches may be folded or rolled together and can be placed in a box for sale and storage. The pouches can be marked with the name of the product as well as usage instructions.

Figure 1:
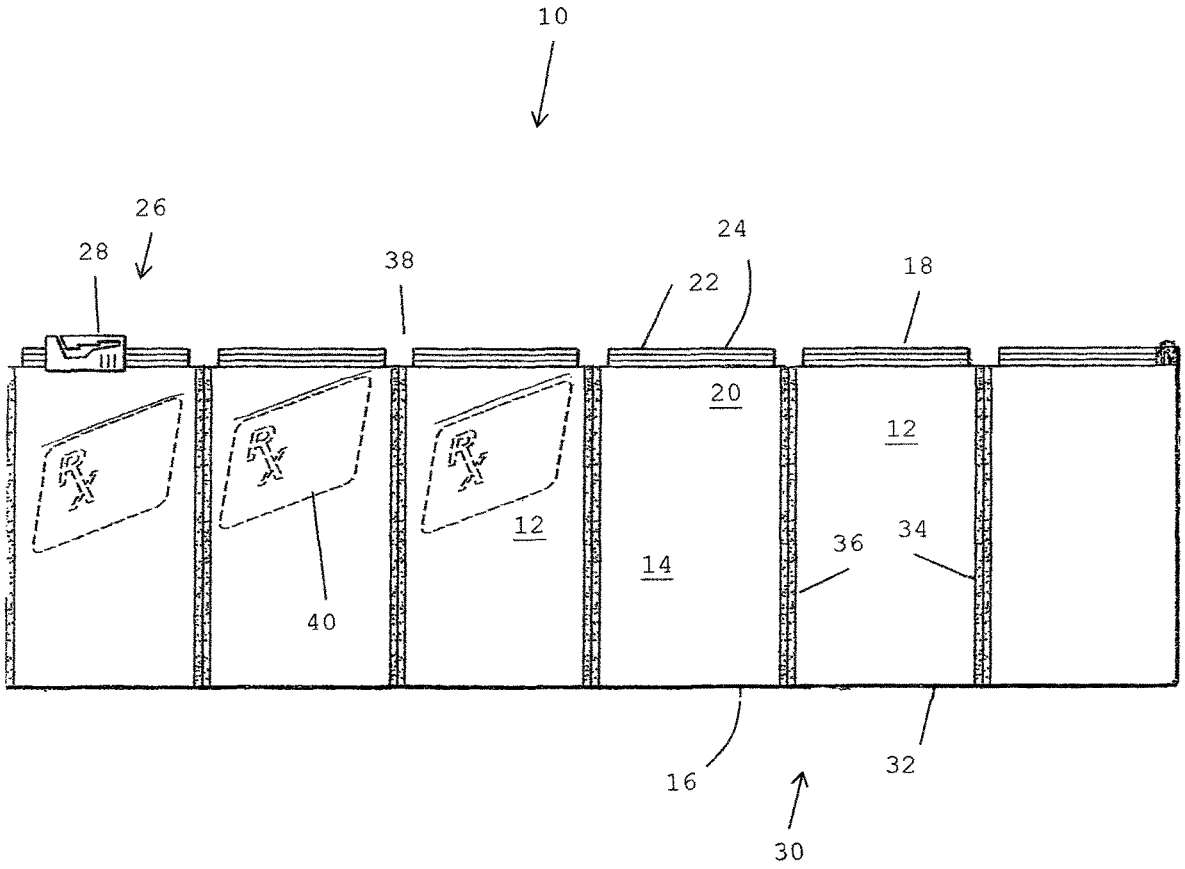
FIG. 1 is side view of a plurality of connected flexible plastic pouches with opening and locking means along a top edge of the present invention.

Referring to FIG. 1, a container 10 is shown by side view having a plurality of pouches 12. Each pouch 12 is approximately rectangular in shape, although other shapes are possible, and has a front and back walls 14 and 16, respectively. The front and back walls 14 and 16 are thin plastic sheets. A track 18 is located along the top edge 20 with a female and male section 22 and 24, respectively, that are removably attached to each other such as with a Ziplock™. The track may further be located on the front wall. The track 18 may be segmented having one section over each pouch. A slider 26 can translate along each track 18. A hinge biased plow 28 is located in the slider 26 and when pressed downward separates the female and male sections 22 and 24 with a wedge shaped wall 105 therefrom. See FIG. 4 and FIG. 11A. The plow 60 enters the distal notch 38 and then the plow 60 enters the distal edge of the notch 38 to open the track, and will exit the next proximal edge of the next notch. The walls 30 are sealed at the edges 32, 34, and 36, as necessary, thereof and at the top are attached to the track 18. Between each adjacent pouch 12 is a tear section 38 so that each pouch may be removed from the group. Logos, instructions and content information 40 may be printed on the pouch walls 30 as well as on any storage box.

Figure 2:
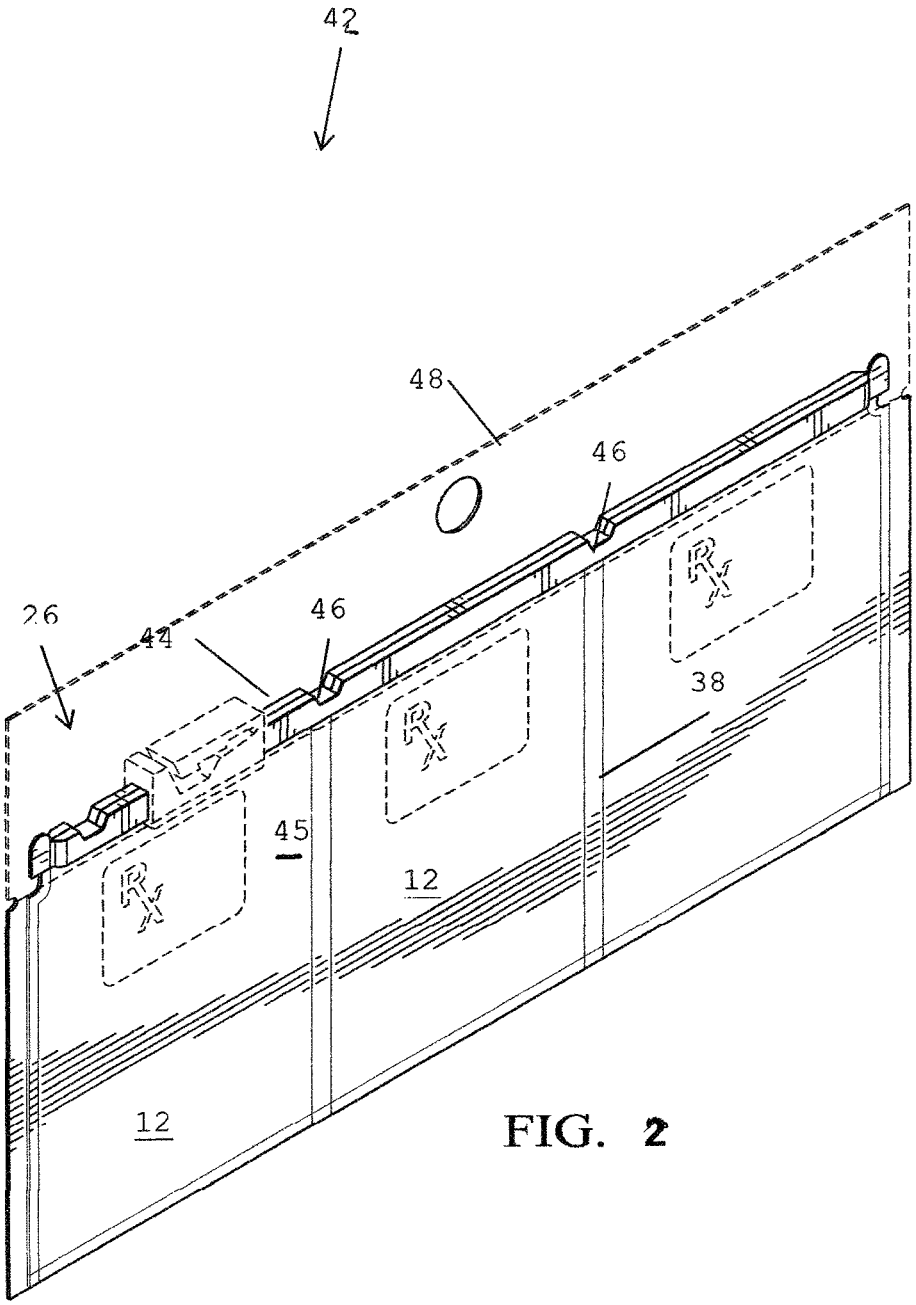
FIG. 2 is a perspective view of another embodiment of a container having plurality of flexible connected pouches with a solid track thereon of the present invention.

FIG. 2 of another embodiment of a container 42 having a plurality of flexible pouches 12 having a solid track 44 along the top edge 45. A slider 26 is shown on the left side of the track 44. Offset notches 46 over the tear sections 38 allow the track 44 to bend and further allow the track to be broken to remove a pouch. A back extended wall 48 may have thereon cutouts to allow the container 42 to be hung therefrom.

Figure 3:
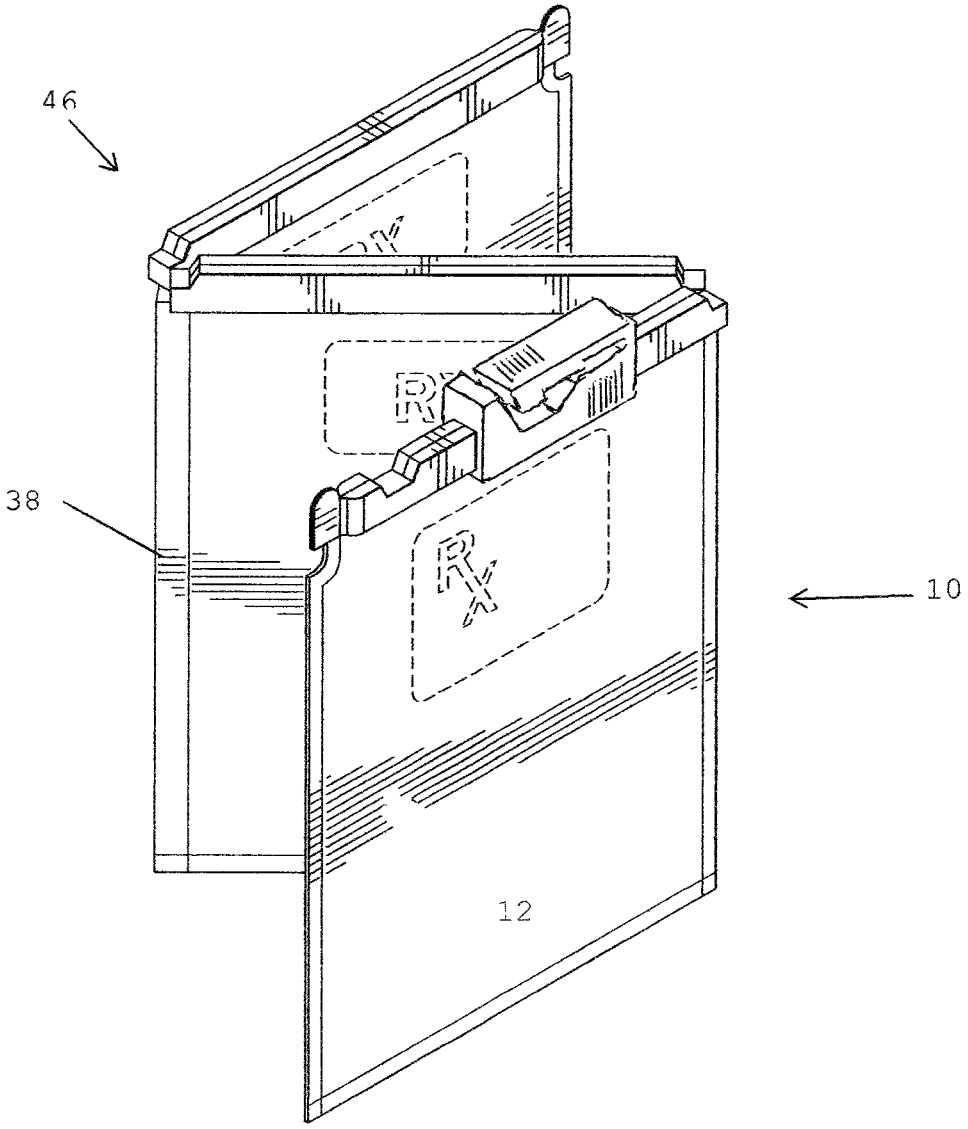
FIG. 3 is a perspective view of a series of connected pouches being folded with pouches like in FIG. 2 of the present invention.
Figure 5:
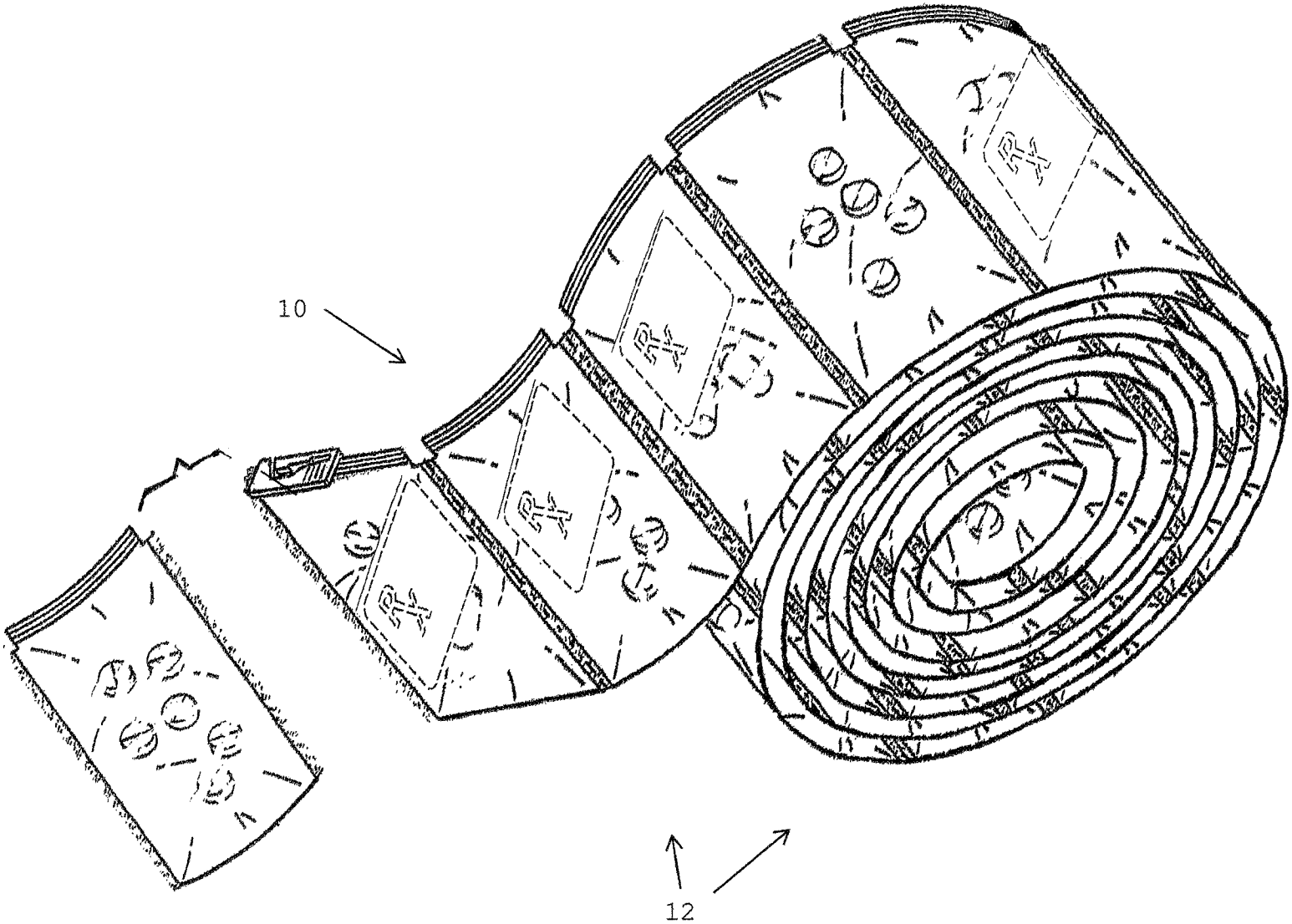
FIG. 5 is a perspective view of the series of connected pouches rolled together of the present invention.
Figure 6:
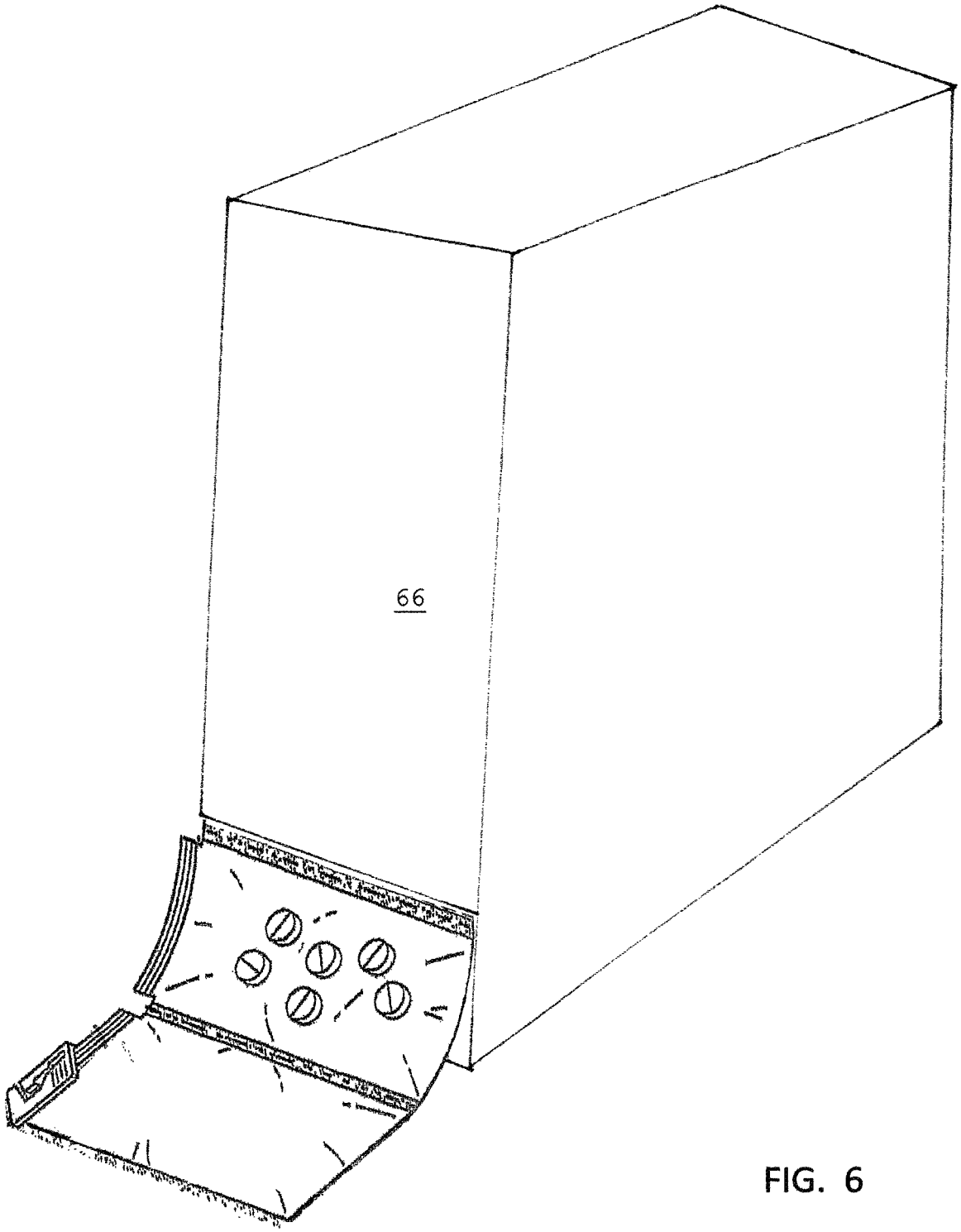
FIG. 6 is a perspective view of a pouch dispensing container with a roller pouches like in FIG. 5 of the present invention.

Referring to FIG. 3, this shows the container 10 being folded upon itself. The individually connected pouches 12 are folded at the tear section 38 with the notch 46 at the top edge being split in half. FIG. 5 illustrates the container 10 being rolled up. Both the rolled up version and the folded version can be stored in a box 10 for sale or storage such as shown in FIG. 6.

Figure 4:
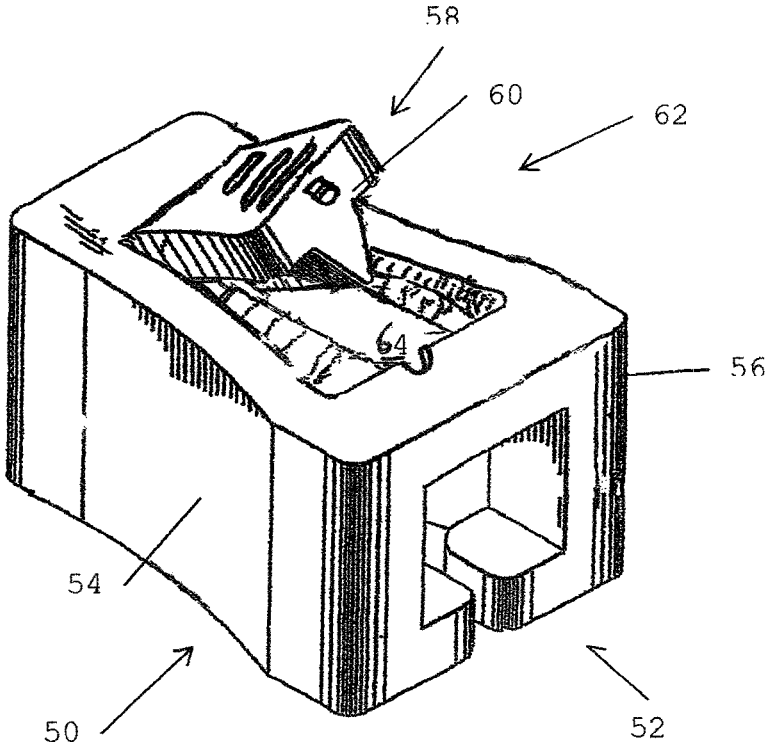
FIG. 4 is an embodiment of a slider with a wedge shaped plow for splitting apart the track of the present invention.
Figure 10:
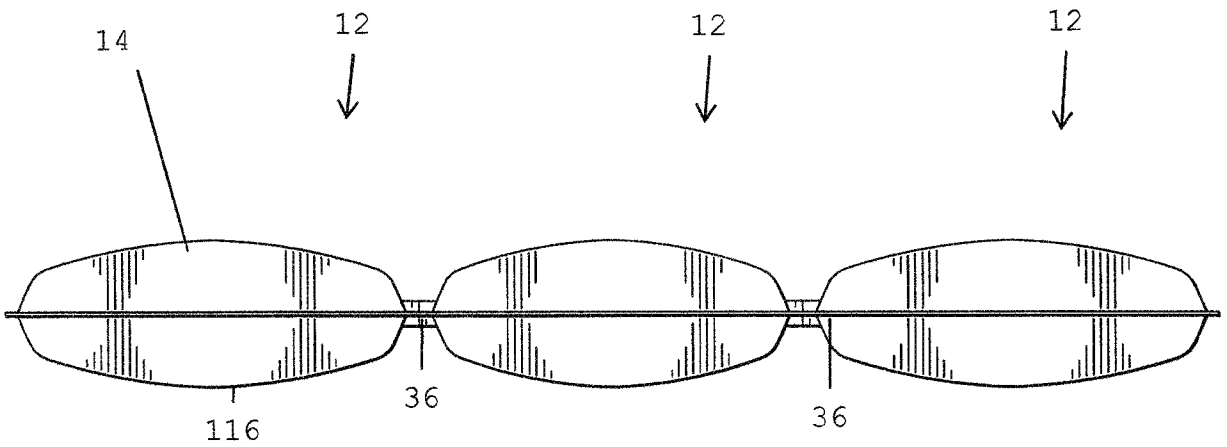
FIG. 10 is a bottom view of a container with material in the pouches.

FIG. 4 illustrates by perspective view another embodiment of a slider 50. The slider 50 is inserted onto track 44 that runs through a track opening 52. The slider 50 has a pair of L-shaped side walls 54 and 56 such that the lower part of the L has the upper part of the pouch 12 therein. The plow 58 is pushed down into the track opening 44 to separate the walls 22 and 24, FIG. 1, by a wedge 60. The plow 58 is spring biased upward as shown and fits within a plow cavity 62 that has a slot 64 in the bottom of the cavity 62. FIG. 10 illustrates by a partial bottom view, the pouches 12 having material therein.

Figure 7A:
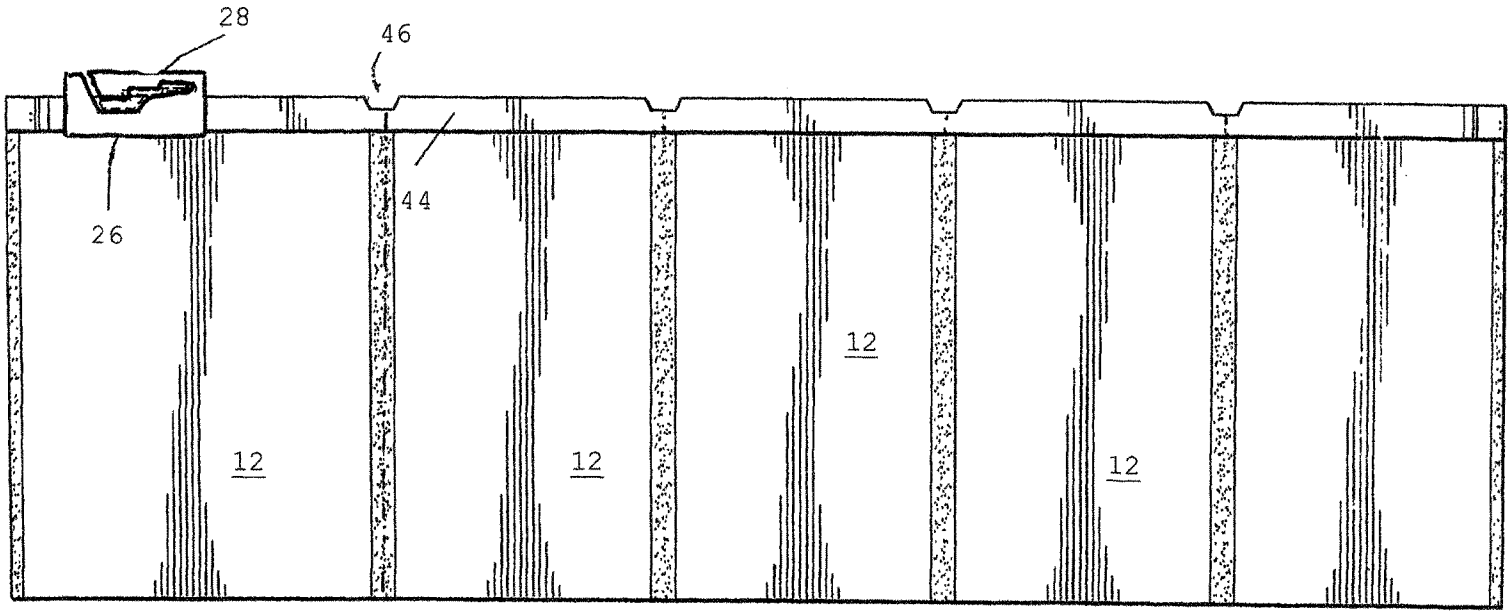
FIGS. 7A and 7B are side and end views of the connected series pouches of the present invention.
Figure 7B:
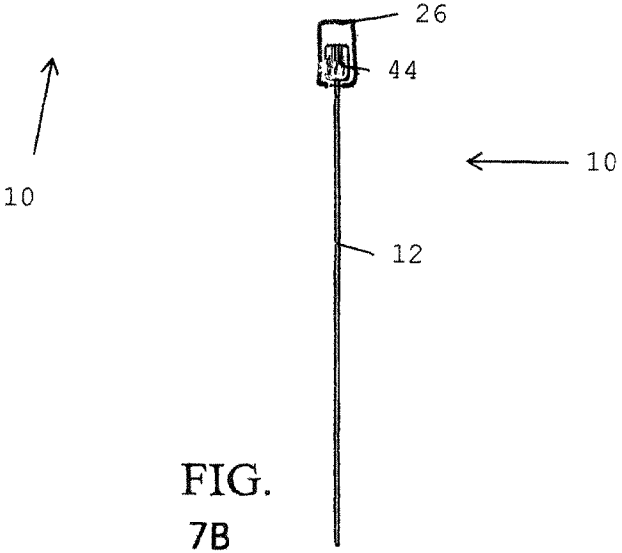

Referring to FIG. 7A, by side view, the container 10 is shown having a continuous track 44 with notches 46 that allow for separating the pouches 12. FIG. 7B is an end view of the container 10 with pouch 12 at the end with the slider 26 positioned over the track 44. The hinged plow 28 is shown also therein.

Figure 8A:
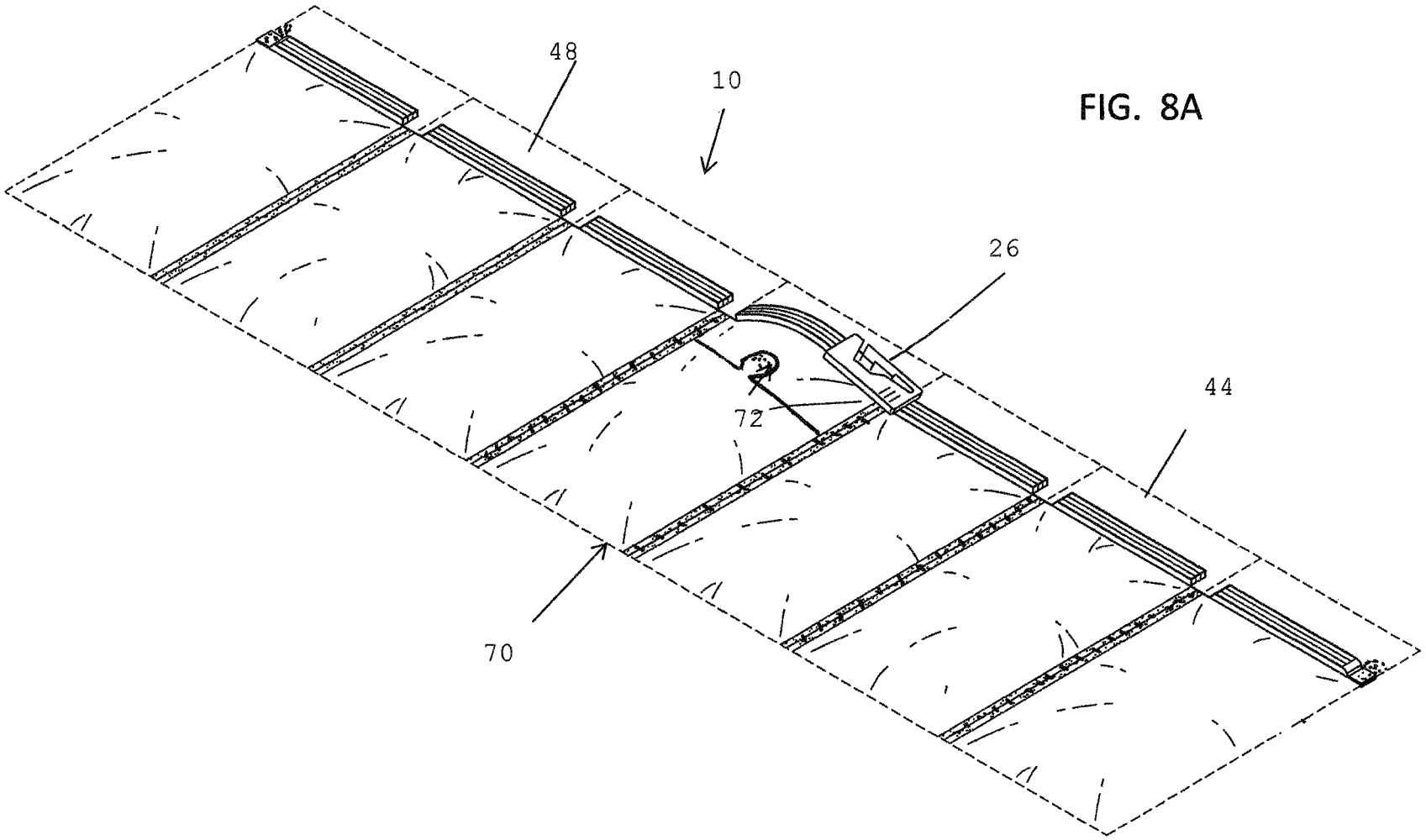
FIG. 8A is a perspective view of a pouch therein having a tear-off opener.
Figure 8B:
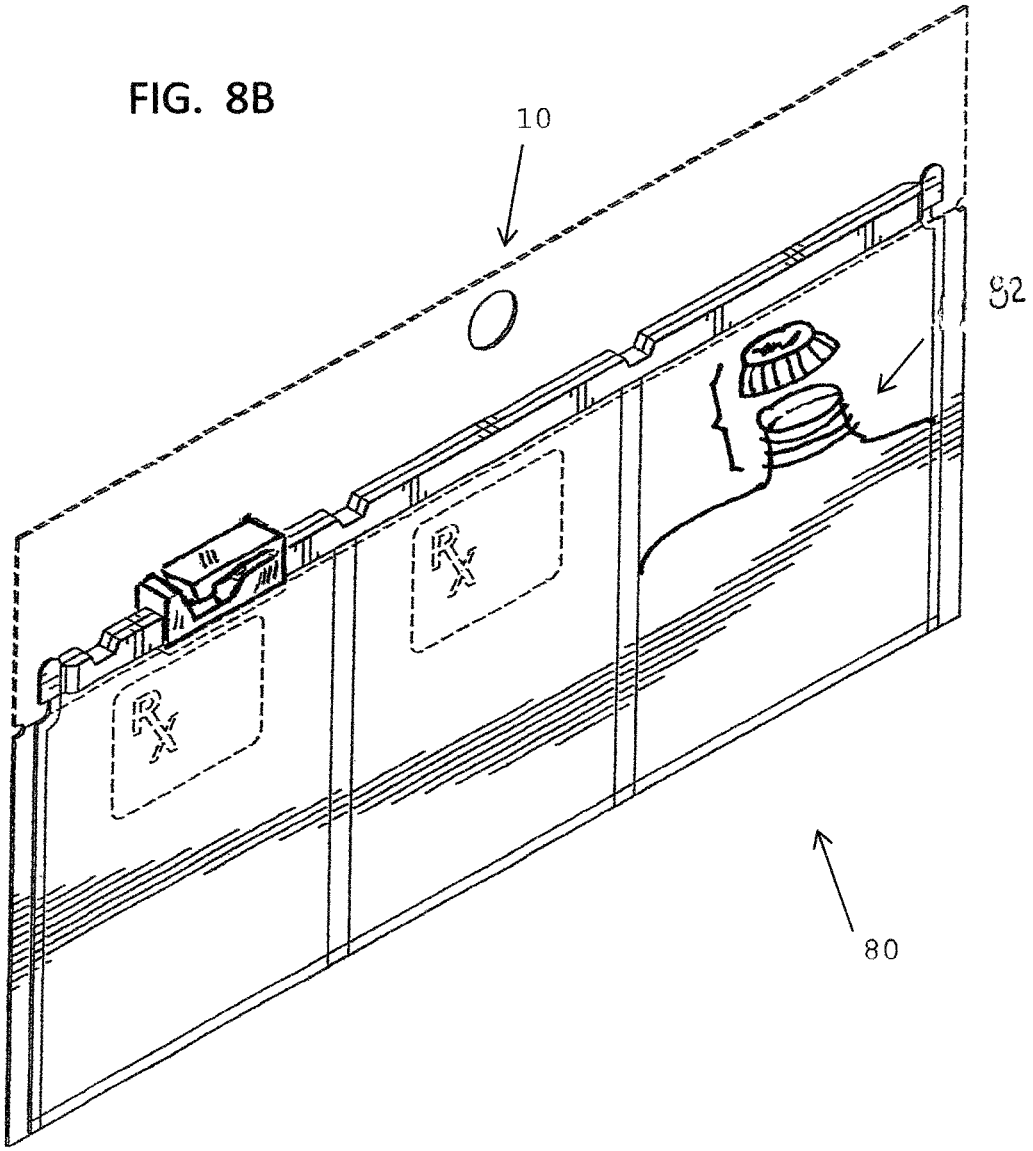
FIG. 8B is a perspective view of a pouch having a twist-off opener of the present invention.

FIG. 8A illustrates the container 10 having an ointment pouch 70 with a tear-off cap 72 that is located lower that the track 44 so that the slider 26 may move thereover. The pouch shown is open but the tear-off cap 72 is not removed. FIG. 8B illustrates a pouch 80 having a twist-off cap 82. The tear-off cap 72 or the twist-off cap 82 can be located inside of the pouch and can not be opened until the pouch itself is opened by the slider.

Referring to FIG. 9A, a pill cutter device 90 is located on top of the slider 26. A pill, not shown, is inserted into a pill holder section 92 and a hinged cap 94 with a cutter 96. The pill cutter device 90 may be removably mounted to the slider 26. FIG. 9B illustrates a pill grinder 100 on the slider 26. A removable cap 102 is placed on the bottom grinder section 104 after a pill is inserted therein. Grinding teeth 106 in the grinder section 104 will crush the pill when the cap 102 is rotated repeatedly. FIG. 9C illustrates a pill crusher 110 having a top cap 112 with crushing blades 116. The top cap 112 is pushed down on the pill in the bottom section 114. It should be understood that other operational features as above may be placed on the slider or provided in the package as sold.

In general, the width of the pouch can be one inch but up to at least five inches. The height of the pouch can be 2 to 3 inches but up to at least eighteen inches. The tear section between the pouches will be least 2.5 mm, but up to at least 5 mm. The plastic walls may be mylar, for example.

Figure 11B:
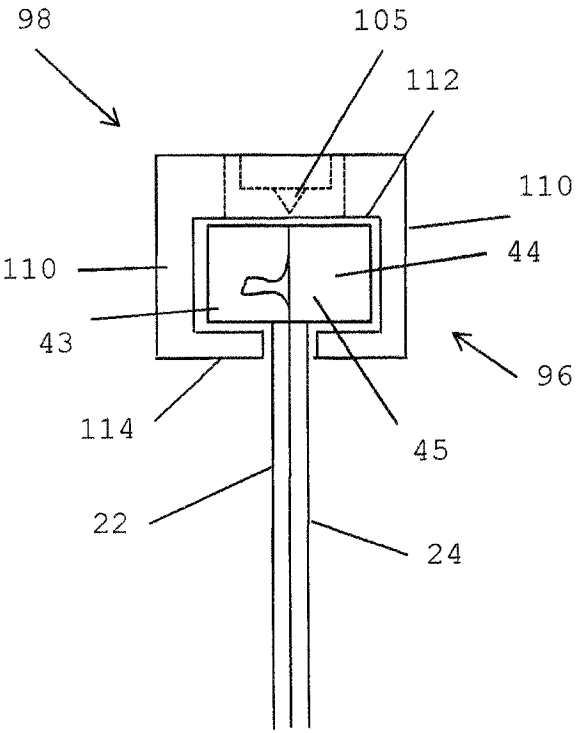
FIG. 11B is an end view of the container of FIG. 11A.
Figure 11A:
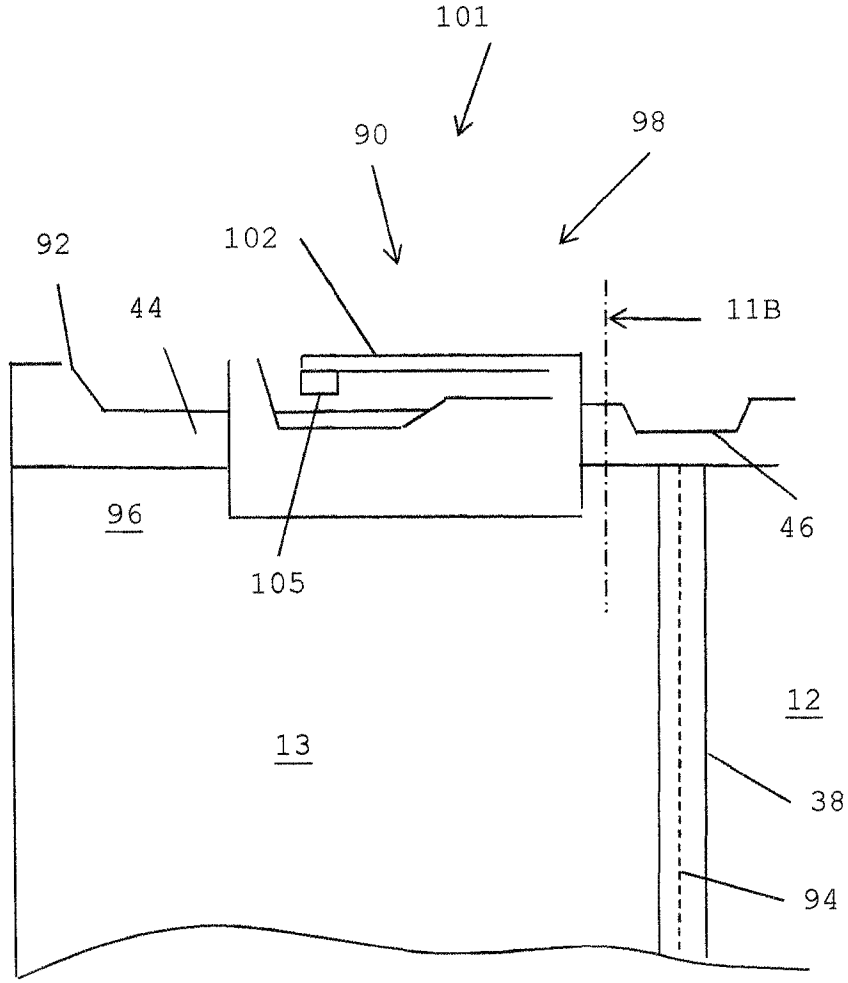
FIG. 11A is a partial side view of the container of the present invention showing a slider mounted to the track.

Referring to FIGS. 11A and 11B, a partial container 101 is shown. FIG. 11A shows an end section 13 attached to a first pouch 12 with a tear out section 38 with a possible slotted rip line 94 to ease the separation of the pouches 12. At a top edge 96, an end block 92, being apart of the track 44 prevents the slider 98 from being removed from the track 44. The slider 98 comprises a main section 100 with a hinged plow 102 thereon. By pressing down on the hinged plow 102, a divider 104 will separate the track 44 when it enters the first cutout notch 46. When it is held down and moved to the right it will separate the track 44 and disengages therefrom at the next cutout notch. The slider 98 is made of plastic and is an integral piece and can be pushed on or pulled from the track 44. FIG. 11B shows a cross sectional view from the right side as indicated. The slider 98 has a pair of L-shaped sides 110 facing each other wherein there is a track section 112 and a pouch wall section 114. The separable walls 22 and 24 are connected to the track 44. The walls 22 and 24 will be separated when the divider 105 is pushed and pulled therein to push apart the female track section 43 and the male track section 45. After the opened pouch is removed, the track sections can be pushed together by hand to close the pouch as desired.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A container for dispensing products, said container comprising:

a flexible pouch, said flexible pouch may be connected to an adjacent pouch, said flexible pouch being substantially rectangular;

a track having two section, said track positioned on said container, said track having a male section and a female section, said sections can be removably attached together and are further attached to wall sections of said flexible pouch; and a slider that travels along said track, a hinged plow on said slider for opening said wall sections by a divider therein, said divider fixedly attached to a non-hinged end of the slider and rests in a hinged plow section, said divider being wedge shaped to enter into the track when pressed downward, said slider being able to reclose an opened pouch by reversing direction, said slider including functional features as a pill splitter, a pill cutter or a pill crusher.

2. A container for dispensing products, said container comprising:

flexible pouches, said flexible pouches being connected to one or more adjacent pouch(es), said flexible pouches being substantially rectangular;

a track having two section, said track positioned on said container, said track having a male section and a female section, said sections can be removably attached together and are further attached to wall sections of said flexible pouch, said track being continuous on each pouch; and a slider that travels along said track, a hinged plow on said slider for opening said wall sections by a divider therein, said divider fixedly attached to a non-hinged end of the slider and rests in a hinged plow section, said divider being wedge shaped to enter into the track when pressed downward, said pouches have one notch between each pouch, said slider being able to reclose an opened pouch by reversing direction, said slider having functional features as a pill splitter, a pill cutter and a pill crusher.

* * * * *